US010487606B2

(12) United States Patent
Swadi et al.

(10) Patent No.: US 10,487,606 B2
(45) Date of Patent: Nov. 26, 2019

(54) BALANCING LOAD ON MILLING CUTTING ELEMENTS

(71) Applicant: SMITH INTERNATIONAL, INC., Houston, TX (US)

(72) Inventors: Shantanu N. Swadi, Cypress, TX (US); John E. Campbell, Houston, TX (US); Shelton W. Alsup, Houston, TX (US)

(73) Assignee: SMITH INTERNATIONAL, INC., Houston, TX (US)

( * ) Notice: Subject to any disclaimer, the term of this patent is extended or adjusted under 35 U.S.C. 154(b) by 361 days.

(21) Appl. No.: 14/957,183

(22) Filed: Dec. 2, 2015

(65) Prior Publication Data

US 2016/0090805 A1 Mar. 31, 2016

Related U.S. Application Data

(63) Continuation of application No. 13/563,378, filed on Jul. 31, 2012, now Pat. No. 9,228,406.

(60) Provisional application No. 61/513,643, filed on Jul. 31, 2011.

(51) Int. Cl.
*E21B 10/43* (2006.01)
*E21B 29/06* (2006.01)

(52) U.S. Cl.
CPC ..... *E21B 29/06* (2013.01); *E21B 10/43* (2013.01)

(58) Field of Classification Search
CPC ..... E21B 29/005; E21B 29/06; E21B 7/061; E21B 7/067; E21B 7/062; E21B 10/43
USPC ..... 166/313, 50, 117.5, 117.6, 298, 255.2, 166/255.3
See application file for complete search history.

(56) References Cited

U.S. PATENT DOCUMENTS 4,266,621 A 5/1981 Brock
5,131,478 A * 7/1992 Brett ..... E21B 10/43 175/399
5,582,261 A * 12/1996 Keith ..... E21B 10/43 175/431
5,771,972 A 6/1998 Dewey et al.
5,816,324 A 10/1998 Swearingen et al.
5,894,889 A 4/1999 Dewey et al.
6,102,123 A 8/2000 Bailey et al.
6,648,068 B2 11/2003 Dewey et al.
(Continued)

OTHER PUBLICATIONS

Article 94(3) Communication issued in related EP application 12820530.9 on Aug. 9, 2016, 5 pages.
(Continued)

*Primary Examiner* — David Carroll

(57) ABSTRACT

A cutting apparatus and method to facilitate milling of a casing window by improving the interaction between the mill and the casing. The cutting apparatus comprises a whipstock having a plurality of ramp sections that provide a ramp profile arranged and designed to cooperate with the cutting structure of a mill to achieve a desired loading on the mill cutting elements during milling of the casing window. The plurality of ramp sections, having specific lengths and oriented at specific angles, adjust the loading on the mill as the mill cuts through the casing during formation of the casing window. The improved whipstock maintains a more balanced loading across the cutting elements during milling operations. Additional mill cutting structures may also be selected and evaluated to further balance the cutting load during window milling.

20 Claims, 10 Drawing Sheets

(56) References Cited

U.S. PATENT DOCUMENTS

| | | | | |
|---|---|---|---|---|
| 7,207,401 | B2 | 4/2007 | Dewey et al. | |
| 2001/0054506 | A1 | 12/2001 | Dewey et al. | |
| 2008/0202754 | A1* | 8/2008 | Soni | E21B 7/061 166/298 |
| 2009/0133877 | A1* | 5/2009 | Neff | E21B 7/061 166/298 |
| 2010/0012322 | A1* | 1/2010 | McGarian | E21B 7/061 166/298 |
| 2010/0276145 | A1* | 11/2010 | Dewey | E21B 7/061 166/298 |
| 2013/0199784 | A1 | 8/2013 | Swadi et al. | |

OTHER PUBLICATIONS

Examiner's Report issued in Canadian Patent Application No. 2843600 dated Apr. 12, 2018, 3 pages.
International Search Report and Written Opinion of PCT Application No. PCT/US2012/049034 dated Nov. 9, 2012, 7 pages.

* cited by examiner

BALANCING LOAD ON MILLING CUTTING ELEMENTS

CROSS-REFERENCE TO RELATED APPLICATIONS

This patent application is a continuation of U.S. patent application Ser. No. 13/563,378, titled "Extended Whipstock and Mill Assembly" and filed on Jul. 31, 2012, which application claims the benefit of, and priority to, U.S. Provisional Patent Application Ser. No. 61/513,643, titled "Extended Whipstock and Mill Assembly" and filed on Jul. 31, 2011. The disclosure of each of the foregoing applications is incorporated herein by this reference in its entirety.

BACKGROUND

Directional drilling has proven useful in facilitating production of fluid, e.g., hydrocarbon-based fluid, from a variety of reservoirs. In many such operations, a vertical wellbore is drilled, and casing is deployed in the vertical wellbore. One or more windows are then milled through the casing to enable drilling of lateral wellbores. Each window formed through the casing is large enough to allow passage of components, e.g., passage of a bottomhole assembly used for drilling the lateral wellbore and of a liner for lining the lateral wellbore. The bottomhole assembly may comprise a variety of drilling systems, such as point-the-bit and push-the-bit rotary drilling systems.

In some operations, the bottomhole assembly is relatively long and lacking in flexibility, which can create difficulty in forming a suitable casing window for passage of the bottomhole assembly. Formation of casing windows, particularly longer and/or larger casing windows to better accommodate longer and stiffer bottomhole assemblies, requires substantial removal of material. Existing whipstock and mill designs tend to create substantial loading on specific cutters or cutter regions of the mill and this can lead to excessive wear and reduction in cutting efficiency, particularly when cutting larger casing windows.

SUMMARY

A cutting apparatus and method to facilitate the milling of a casing window by improving the interaction between a mill and the casing during milling are disclosed. In one or more embodiments, the cutting apparatus comprises a cutting tool coupled to a downhole end portion of a rotatable shaft, which rotates the cutting tool. The cutting tool has a plurality of cutting elements disposed in an outer surface thereof. Each of the cutting elements is designed to cut a volume of borehole wall. The cutting apparatus also comprises a whipstock having a plurality of ramps disposed on an axial surface thereof. The plurality of ramps have ramp angles and lengths arranged and designed to progressively deflect the cutting tool into engagement with the borehole wall and cut through the borehole wall. The ramp angles and lengths are selected to adjust loading on the plurality of cutting elements and cause the difference between the volumes of borehole wall cut by radially adjacent cutting elements to approach zero. In one or more embodiments, the plurality of cutting elements disposed in an outer surface of the cutting tool may also be arranged to limit the absolute difference in calculated casing volume removed by radially adjacent cutting elements in the casing cutting section to less than about 35 percent. In one or more other embodiments, the absolute difference in calculated casing volume removed by radially adjacent cutting elements in the casing cutting section may range from less than about 35 percent to less than about 10 percent.

In one or more embodiments, the method comprises determining the configuration of a mill cutting structure used to cut a window in a well casing. The cutting structure of the mill has a plurality of cutting elements. The method also comprises selecting a whipstock having a plurality of ramp sections. Each ramp section of the plurality of ramp sections has a length and angular orientation designed to cooperate with the configuration of the cutting structure of the mill to produce a predetermined balancing of cutting load between the plurality of cutting elements during cutting of the window in the well casing. The predetermined balancing of cutting load is produced when the difference between volumes of well casing cut by radially adjacent cutting elements of the plurality of cutting elements is driven towards zero. In one or more embodiments, the method to facilitate milling a window in a cased wellbore comprises selecting a mill having a cutting structure arranged and designed to mill the window in the well casing; selecting a whipstock having a plurality of ramp sections configured to move the mill in a lateral direction during milling of the window, the whipstock and mill being selected such that the configuration of the plurality of ramp sections cooperates with the cutting structure of the mill to adjust loading on the cutting structure of the mill and increase length of well casing milled; and milling the window in the well casing.

After the whipstock is selected, additional mill cutting structures may be selected and evaluated to further balance the loading on the mill experienced during window cutting. At least one such additional mill cutting structure increases the number of cutting elements within one or more sections of the mill that are subjected to the most casing cutting load. In one or more embodiments, the ramp sections of the whipstock have a length and an angular orientation selected such that the window milled through the wall of the borehole permits components of a bottomhole assembly to experience a calculated dogleg severity no greater than about 8 degrees per 100 feet while negotiating the ramp profile of the whipstock and passing through the milled window.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF THE DRAWINGS

Certain embodiments of the present disclosure will hereafter be described with reference to the accompanying drawings, wherein like reference numerals denote like elements.

DETAILED DESCRIPTION

In the following description, numerous details are set forth to provide an understanding of the present disclosure. However, it will be understood by those skilled in the art that one or more embodiments of the present disclosure may be practiced without these details and that numerous variations and/or modifications of the described embodiments may be possible without departing from the scope hereof.

One or more embodiments disclosed herein generally relate to an apparatus and method to facilitate the milling of casing windows to enable drilling of lateral wellbores. In one or more embodiments, the apparatus comprises a cutting tool coupled to a downhole end portion of a rotatable shaft, which rotates the cutting tool. The cutting tool has a plurality of cutting elements disposed in an outer surface thereof. Each of the cutting elements is designed to cut a volume of borehole wall. The apparatus also comprises a whipstock having a plurality of ramps disposed on an axial surface thereof. The plurality of ramps have ramp angles and lengths arranged and designed to progressively deflect the cutting tool into engagement with the borehole wall and cut through the borehole wall. The ramp angles and lengths are selected to adjust loading on the plurality of cutting elements and cause the difference between the volumes of borehole wall cut by radially adjacent cutting elements to approach zero.

In one or more embodiments, the method comprises designing specific, cooperating mills and whipstocks to achieve a more desirable loading of the cutters on the mill during milling of a casing window. As described in greater detail below, the method may be an iterative process resulting in a plurality of ramp sections disposed at unique and/or particular angles along the entire ramp or face of the whipstock. The ramp section lengths and angles may be selected according to the design and arrangement of the cutting elements on the mill to achieve a desired or predetermined loading during removal of casing material. For example, the whipstock ramp may be designed to improve the balance of loading across the cutters of the mill, to enhance the life of the mill and/or to preserve the efficiency of cutting during milling of larger casing windows.

Figure 1:
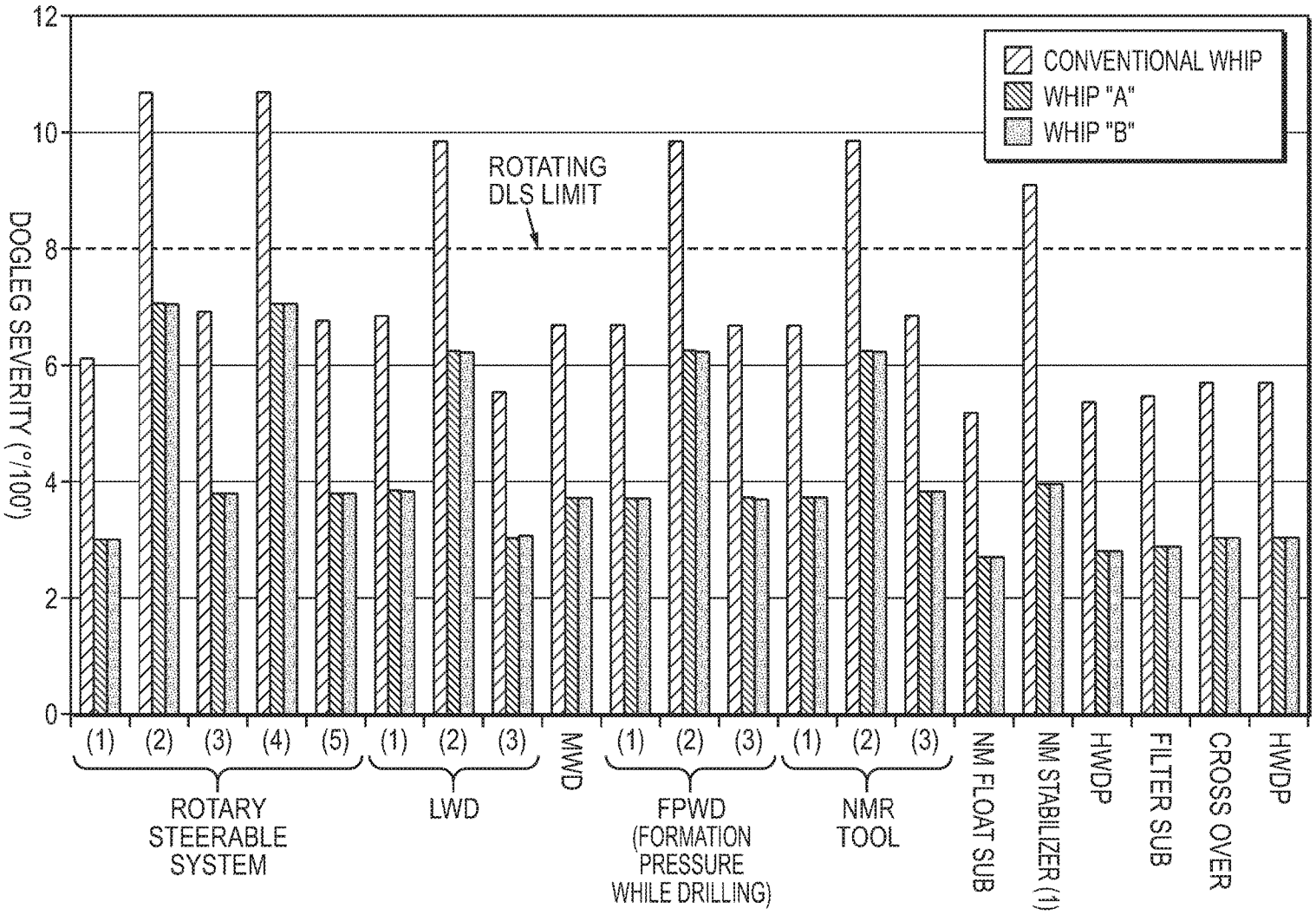
FIG. 1 is a graphical representation of the dogleg severity experienced by various components of a single bottomhole assembly while rotating through a milled casing window using a conventional whipstock versus whipstock embodiments according to the present disclosure.

The method also may be used to assist in the design of a whipstock to mill a casing window better able to accommodate the dogleg severity (DLS) limit for a variety of directional drilling tools. Generally, and as shown in FIG. 1, dogleg severity is measured in degrees per 100 feet and may be specified for major directional drilling tools, such as rotary steerable systems, positive displacement motors, long measurement tools, and drilling bottomhole assemblies, among others. The DLS number is an indirect indication of the extent to which such tools can be subjected to cyclical stress without premature failure during the drilling operation. The maximum rotating DLS that bottomhole assemblies should experience is about 8.0 degrees per 100 feet. However, lower DLS values—well below the designated maximum—are preferred. During a sidetracking operation, the drill string negotiates a curved path as it travels over the whipstock and into the formation on its way to the final target. However, as will be disclosed in greater detail below, the ramp configuration of the whipstock can be specifically designed to allow the drill string to stay below the specified DLS threshold while rotating and negotiating the curved path, thereby preventing premature drill string failures.

Figure 2A:
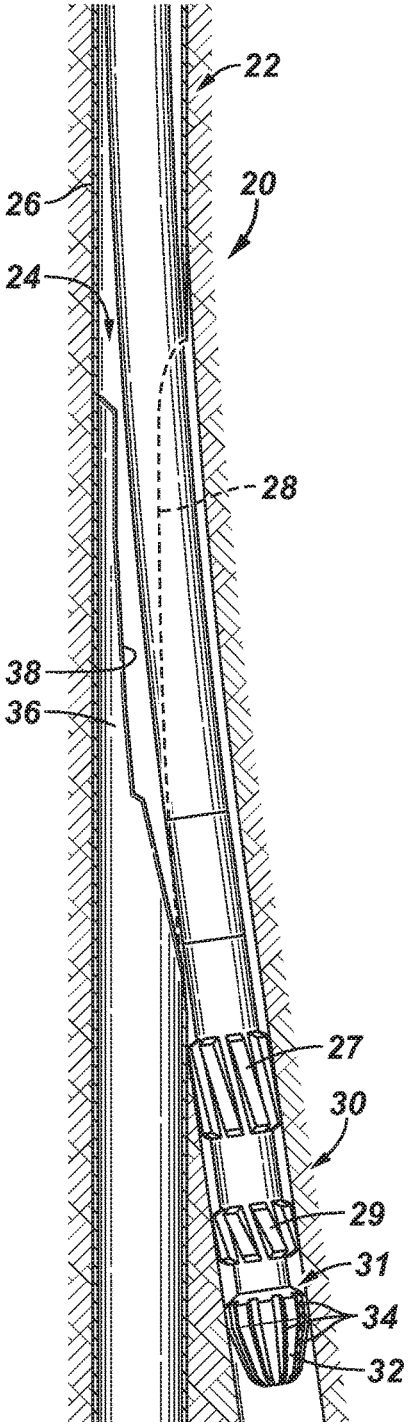
FIGS. 2A and 2B illustrate a whipstock and milling system deployed in a well to mill a casing window and drill at least a partial lateral wellbore, according to one embodiment of the present disclosure.
Figure 2B:
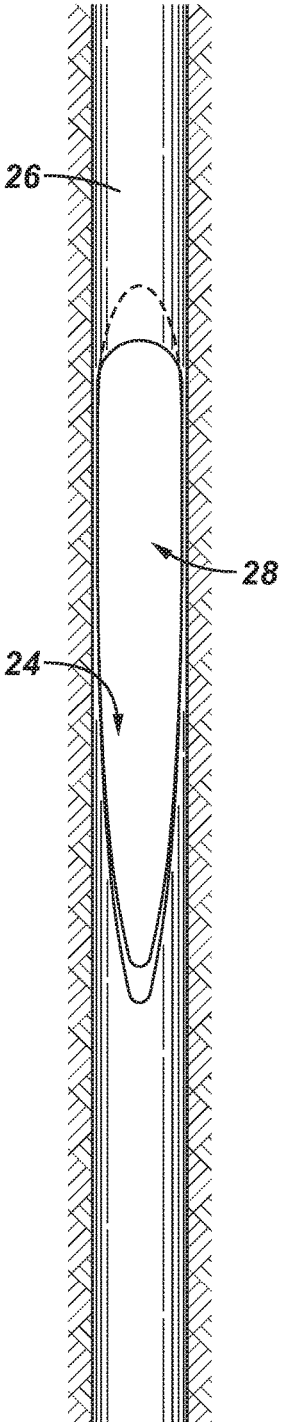

Referring generally to FIG. 2A, an embodiment of a milling system 20 is illustrated as employed in a well 22. The well 22 comprises a vertical wellbore 24 lined with a casing 26, and the milling system 20 is constructed to facilitate milling of a casing window 28 and drill at least a partial lateral wellbore 30. The milling system 20 comprises a conventional mill 31 having cutters 34 arranged to mill the casing window 28. In addition to the conventional mill 31, the milling system 20 may also have a follow mill 29 and a dress mill 27. A whipstock 36 is positioned in the vertical wellbore 24 and secured by, for example, a hydraulic anchor (not shown) or other device known to those skilled in the art. The whipstock 36 comprises a ramp profile or face 38 specifically configured, according to one or more embodiments herein, to accommodate the cutter design of the mill 31 so as to achieve a more desired or predetermined loading on the mill cutters 34 during formation or milling of the casing window 28. FIG. 2B best illustrates the milled casing window 28, which has been milled by the milling system 20 of FIG. 2A.

Figure 3A:
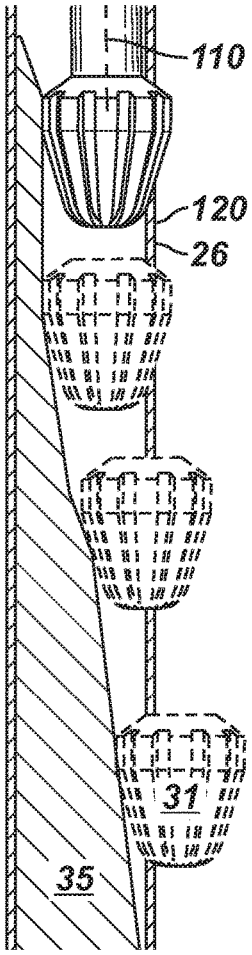
FIG. 3A is a graphical representation of a conventional mill as it moves downwardly along a conventional whipstock and is thus moved laterally into the wall of the borehole thereby milling a window therethrough.
Figure 3B:
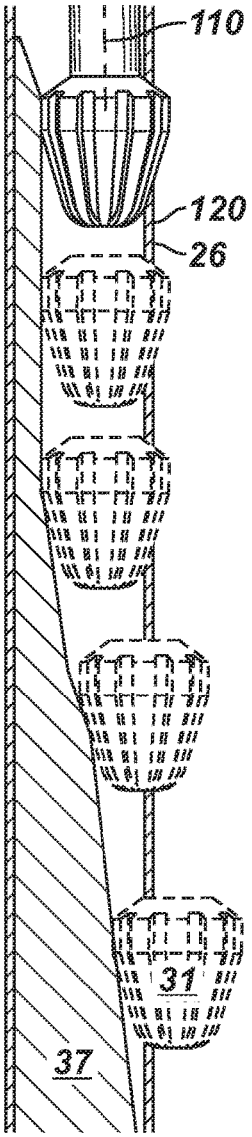
FIG. 3B is a graphical representation of a conventional mill as it moves downwardly along an extended length conventional whipstock and is thus moved downwardly through the wall of the borehole for a greater distance thereby milling a longer/larger window therethrough.
Figure 3C:
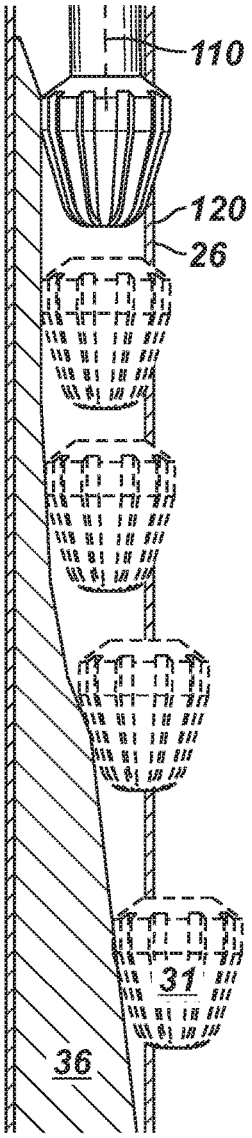
FIG. 3C is a graphical representation of a mill and extended length whipstock according to embodiments of the present disclosure in which a plurality of ramps in the extended length whipstock move the mill laterally with each ramp angle such that the individual cutting elements disposed on the mill experience a more balanced cutting load.

As shown in FIG. 3A, a conventional whipstock 35 of conventional length permits a casing window (not shown but see, e.g., 28 of FIG. 2B) of conventional length to be milled through casing 26 (i.e., the portion of the casing 26 milled by mill 31 as mill 31 progresses downward along the whipstock 35 is shown between the phantom mills). FIG. 3B illustrates that a longer, larger-area casing window may be milled if the whip 35 is simply extended (as represented by whipstock 37); however the same region and cutting elements of the mill 31 are subjected to the majority of the increased casing cutting load. FIG. 3C illustrates a mill 31 using a whipstock 36 of one embodiment of the present disclosure which is designed to more optimally shift mill 31 laterally while mill 31 is milling casing window 28. Thus, various regions and cutting elements of the mill 31 are more evenly used to cut the casing window 28, thereby acting to balance the volume of casing removed per cutter/cutting element 34.

Figure 4:
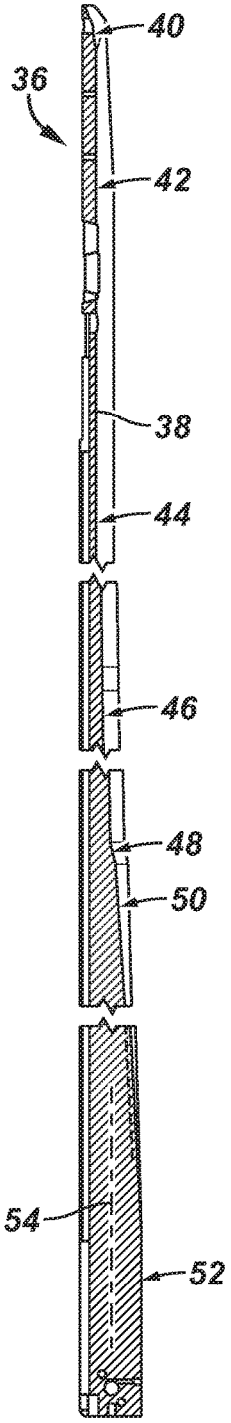
FIG. 4 is a cross-sectional view taken along a longitudinal axis of a whipstock, according to one embodiment of the present disclosure.

In FIG. 4, a whipstock 36 is illustrated wherein its ramp profile 38 is designed to achieve a desired loading across the cutters 34 of a specific mill 31. In this example, the whipstock ramp profile/face 38 is formed by a plurality of distinct ramp sections 40, 42, 44, 46, 48, 50 and 52, which are designed and oriented to move the mill 31 in a progressive, lateral direction during milling of the casing window 28. The plurality of ramp sections are designed for the specific mill 31 to adjust the loading on individual mill cutters 34 according to a desired, predetermined pattern during milling of the casing window 28. For example, each ramp section 40, 42, 44, 46, 48, 50 and 52 may be oriented at a unique and/or particular angle (i.e., slope angle) with respect to a longitudinal axis 54 of the whipstock 36 and each ramp section 40, 42, 44, 46, 48, 50 and 52 may have a unique and/or particular length.

The number of ramp sections and the angular orientation of sequential ramp sections may vary substantially depending on the design of mill 31 and on the desired size, shape and length of casing window 28 (FIG. 2B). As disclosed above, some lateral drilling operations benefit from a substantially longer casing window to accommodate relatively longer bottomhole assemblies (i.e., to reduce DLS). The milling of these types of casing windows may require a substantially longer whipstock 36 with appropriately designed ramp sections. In the example illustrated in FIG. 4, the overall length of the whipstock 36 is substantially longer (6 feet longer as shown but may range from 3 to 8 feet longer) than conventional whipstocks to facilitate drilling of larger casing windows 28. However, the length, the number of ramp sections, and the angular orientation of the ramp sections may be specifically designed to accommodate many arrangements of cutters 34 and many types of casing windows 28. Although at least six ramp sections 40, 42, 44, 46, 48 and 50 are illustrated as having unique and/or particular angular orientations relative to axis 54, other designs may comprise fewer specifically oriented ramp sections, e.g., 3-5 ramp sections, or additional ramp sections. Furthermore, the whipstock may be comprised entirely of ramp sections that are non-linear (i.e., curved) or have one or more non-linear ramp sections disposed between or adjacent to generally linear ramp sections.

Figure 5:
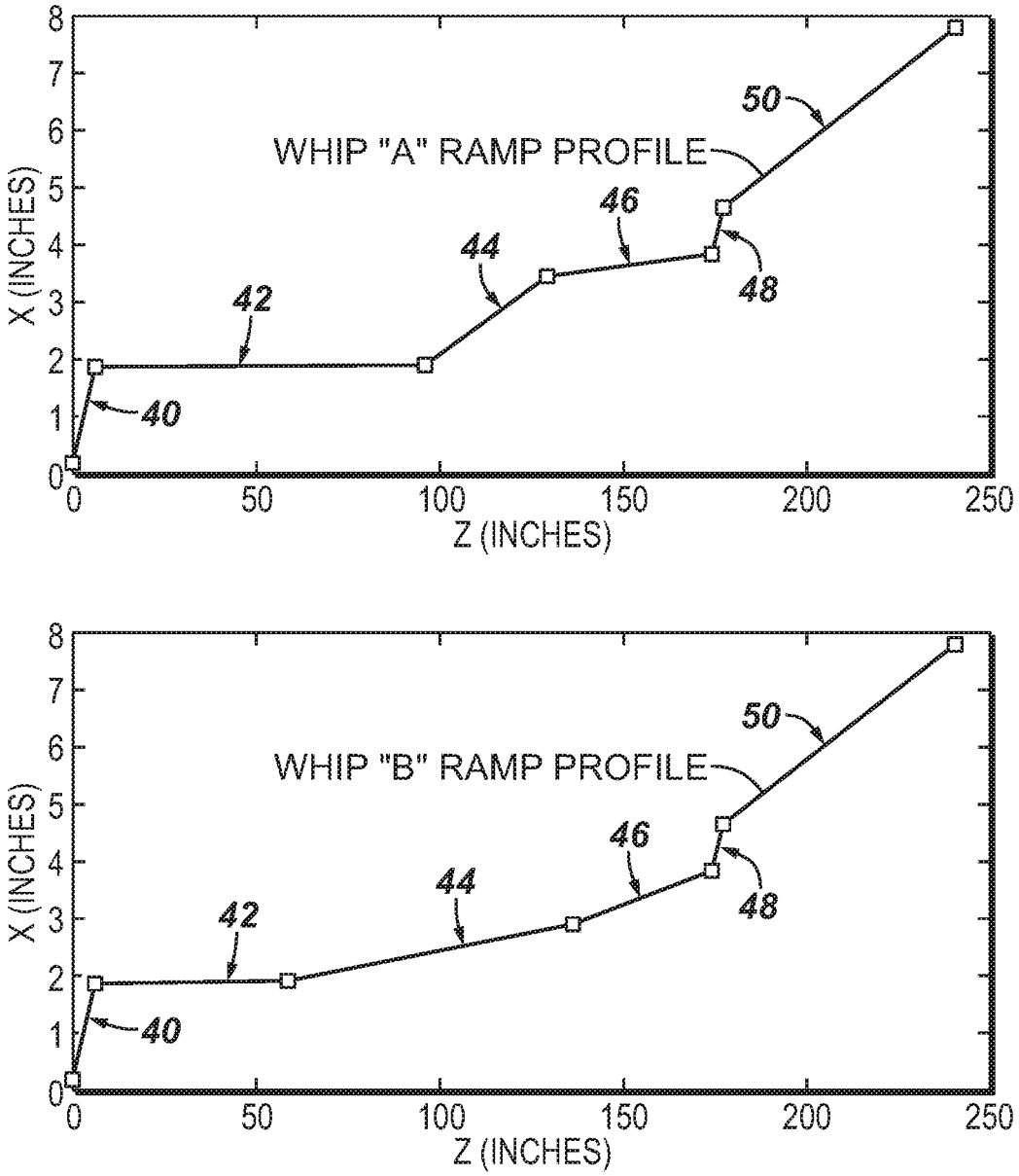
FIG. 5 is a graphical representation of the ramp sections and the ramp section angles along the faces of two whipstocks, according to embodiments of the present disclosure.

As illustrated in the graphs of FIG. 5, whipstocks 36 (see FIGS. 2A and 4) may have different whipstock ramp profiles formed by various lengths and angular orientations of the various ramp sections. In FIG. 5, two different whipstock ramp profiles are illustrated as having ramp sections of differing lengths (Z axis) with differing angular orientations (slope angle). The graphs also illustrate differences in the progressive, lateral movement (X axis) of the mill caused by the whipstock 36 during a casing milling operation. However, many other whipstock ramp profiles may be designed to provide desired loading characteristics with respect to a given mill and a given arrangement of cutters. In the upper graph of FIG. 5, a ramp profile, Whip "A", is shown comprising sequential ramp sections arranged in a sequence of approximately greater than 14.0 degrees (ramp section 40), about 0 degrees (ramp section 42), about 2.0-3.5 degrees (ramp section 44), about 0 to 1.0 degrees (ramp section 46) and approximately greater than 14.0 degrees (ramp section 48). The bottom portion of the ramp profile, illustrated in the upper graph of FIG. 5, has a ramp section 50 with a ramp angle of approximately 2.5-3.5 degrees and then the subsequent ramp section returns to about 0 degrees (not shown). In the lower graph of FIG. 5, for example, ramp profile, Whip "B", which corresponds to the whipstock illustrated in FIG. 4, comprises sequential ramp sections arranged in a sequence of approximately greater than 14 degrees (ramp section 40), about 0 degrees (ramp section 42), about 0.5-1.0 degrees (ramp section 44), about 1.2-2.0 degrees (ramp section 46), and approximately greater than 14.0 degrees (ramp section 48). The bottom portion of the ramp profile, illustrated in the lower graph of FIG. 5, has a ramp section 50 with a ramp angle of approximately 2.5-3.5 degrees and then the subsequent ramp section returns to about 0 degrees (not shown).

Figure 6:
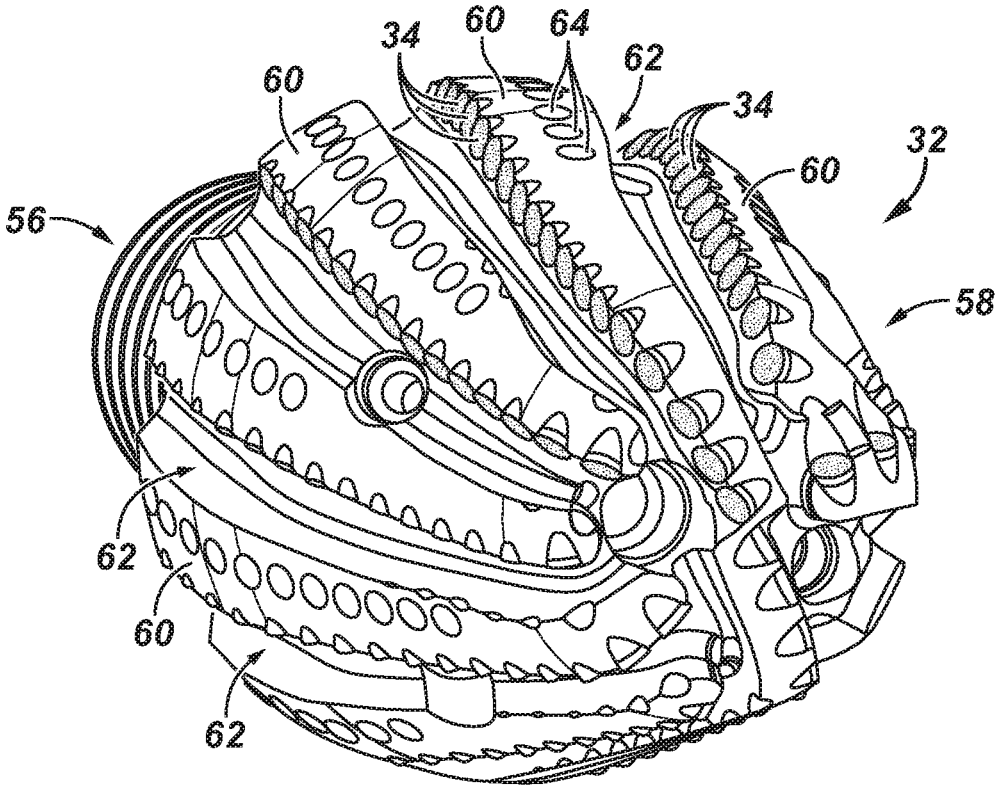
FIG. 6 is an illustration of a mill that can be used to form the casing window, according to one embodiment of the present disclosure.

Referring generally to FIG. 6, an example of a mill 32 is illustrated, which is arranged and designed, in accordance with one or more embodiments of the present disclosure, to achieve a more desired loading (or predetermined loading) on the mill cutters 34 during formation or milling of the casing window 28. However, mill 32, and its specific arrangement of cutters 34, are provided only as examples, and the actual mill design and cutter arrangement can vary substantially depending on parameters related to the casing, environment, desired casing window size, bottomhole assembly, and/or overall drilling operation. The illustrated mill 32 may be employed for both milling and drilling operations (i.e., to mill the casing window and to at least partially drill a lateral borehole). In many applications, however, mill 32 is designed solely for milling the casing window 28 (FIG. 2B) and a separate drill bit is run downhole to drill the lateral wellbore 30 (FIG. 2A).

In the example illustrated, mill 32 comprises an attachment end portion (or shank) 56 and a cutting end portion 58. The cutting end portion 58 comprises the plurality of cutters or cutting elements 34 which may be in the form of polycrystalline diamond compacts (PDC) cutters or other suitable cutters designed and positioned to mill through casing 26 and optionally, to drill at least an initial portion of the lateral wellbore 30. As shown, cutters 34 are mounted on blades 60 separated by junk channels 62, although other mill designs may utilize other types of mounting structures for cutters 34. In the example illustrated, the cutting end 58 has a plurality of back-up components 64 which are positioned to control, e.g., limit, the depth of cutting by cutters 34. By way of example, the back-up components 64 may be in the form of inserts inserted into blades 60 behind corresponding cutters 34.

Figure 7A:
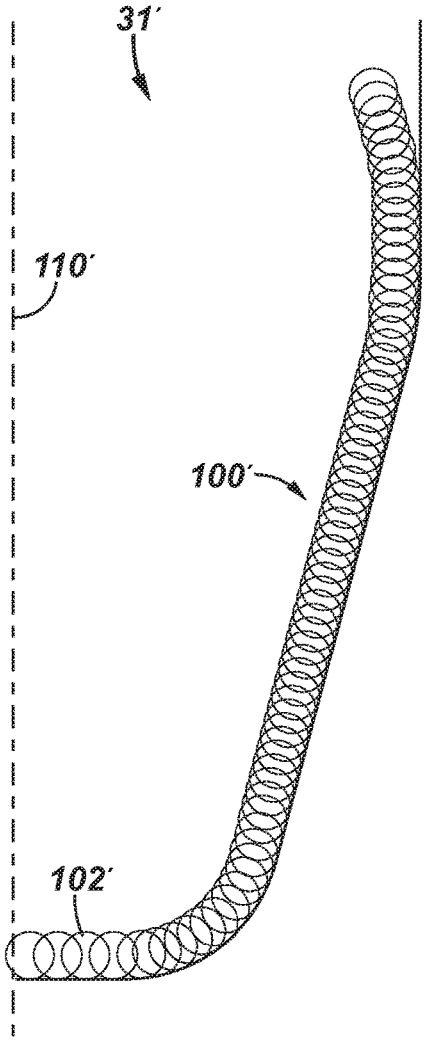
FIG. 7A is a graphical representation of the cutting profile of a conventional mill wherein the cutting profile of the individual cutting elements appears as if the cutting elements are on disposed on a single mill blade.
Figure 7B:
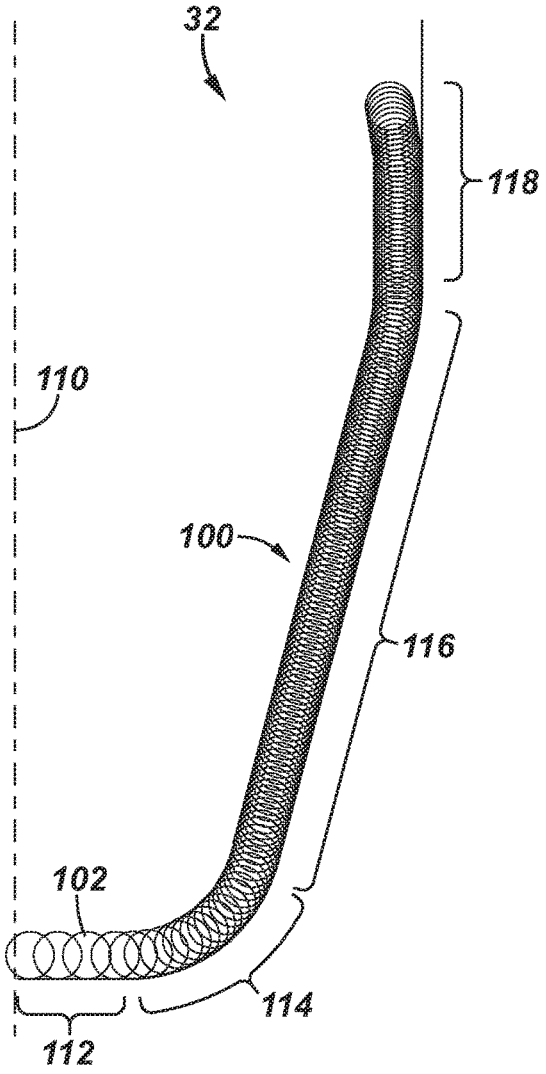
FIG. 7B is a graphical representation of the cutting profile of a mill according to one embodiment of the present disclosure wherein the cutting profile of the individual cutting elements appears as if the cutting elements are disposed on a single mill blade.

According to one embodiment, designed mill 32 is a 8.5 inch diameter mill used to cut a window through 9 ⅝ inch, ½ inch thick casing. The cutting profile/structure of mill 32 is illustrated in FIG. 7B, wherein the combined cutting profile 100 of the individual cutting elements, e.g., single cutter profile 102 represents a single cutting element (not shown but see, e.g., 34 of FIG. 6), is shown as if the cutting elements are disposed on a single mill blade (rather than being disposed on multiple mill blades). The central axis of the mill 32 is represented by the dotted line 110, such that the individual cutting elements are shown in their relative radial positions/distances from the central axis 110. The cutting elements in the region generally designated by reference number 112 are disposed in the cone section of the mill 32, the cutting elements generally designated by reference number 114 are disposed in the nose section of the mill 32, the cutting elements generally designated by reference number 116 are disposed in the taper section of the mill 32 and the cutting elements generally designated by reference number 118 are disposed in the gage section of the mill 32. FIG. 7A illustrates an analogous combined cutting profile for a similarly sized, conventional mill 31'. As can easily be understood by those skilled in the art, a comparison of the cutting profiles of the improved mill 32 and the conventional mill 31' shows that the number of cutting elements has been increased in the nose/taper 114/116 interface and taper section 116 of the improved mill 32. In one embodiment of mill 32, there is no redundancy in cutting elements at any given radial position from the central axis 110. However, it will be obvious to those skilled in the art that such redundancies may be of some benefit.

Figure 8:
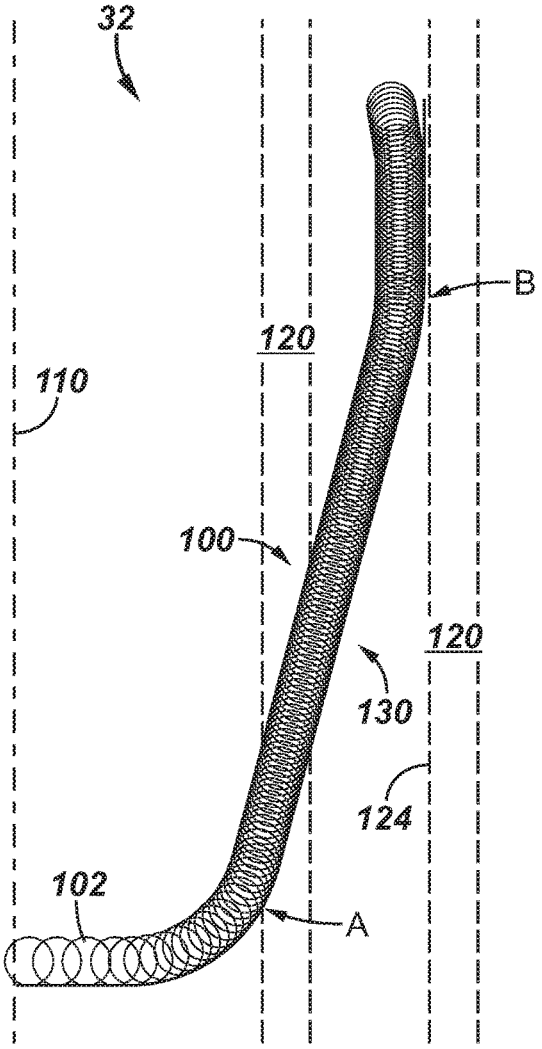
FIG. 8 is a graphical representation of the cutting profile of a mill, according to one embodiment of the present disclosure, with ghost outlines of casing wall drawn to better define the individual cutting elements disposed on the mill that primarily cut the casing wall while the mill moves along the extended length section of a whipstock, according to one embodiment of the present disclosure.

FIG. 8 also illustrates the combined cutting profile 100 of the mill 32 as shown in, and previously described with respect to, FIG. 7B. In FIG. 8, the combined cutting profile 100 is shown with ghost outlines of the casing wall 120 drawn to better define the radial positioning of the individual cutting elements (not shown but their profiles 102 shown) disposed on the mill 32 that primarily cut the single casing wall 120 when the mill 32 moves along the extended length section of a whipstock of the present disclosure (not shown but see, e.g., FIG. 4). The single casing wall 120 is represented by two ghost outlines solely to illustrate and define the regions of the combined cutting profile 100 of mill 32 that are primarily involved in cutting the casing wall 120. In FIG. 8, it may be misinterpreted that the casing wall 120 is moved laterally into the mill 32 (while mill 32 is held stationary) during milling operations. The opposite is true in that the mill 32 is moved or deflected laterally by the ramp sections of the whipstock into milling contact with the casing wall 120. The cutting elements represented by the individual cutting profiles 102 between about point "A" and about point "B", shown on FIG. 8, are the cutting elements that primarily cut the single casing wall 120 and experience the majority of the casing cutting load. This casing cutting section 130 (from about point "A" to about point "B") is the region of mill 32 in which additional cutting elements are disposed in order to better balance the volume of casing removed per cutter or cutting element.

Figure 9:
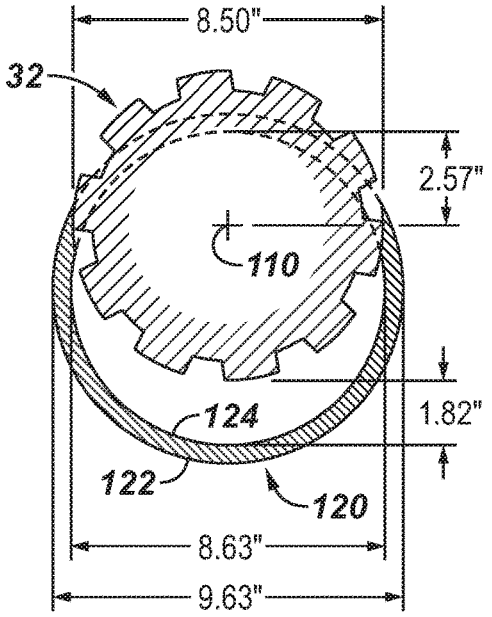
FIG. 9 is a schematic view of a mill as it mills casing by moving downwardly along the lateral displacement provided by a whipstock, according to one embodiment of the present disclosure.

The casing cutting section 130 is alternatively shown in FIG. 9. A schematic view of the mill 32 is illustrated as it mills casing 120 by moving downwardly along the lateral displacement provided by a whipstock (not shown). The 8.5 inch gage mill 32 is shown with its widest diameter in the middle of the casing wall 120—to mill a "full-gage" width of window. The lateral displacement provided by one embodiment of a whipstock of the present disclosure (not shown), along its extended ramp section 42 (not shown but see, e.g., FIG. 4), is 1.82 inches. The inner diameter of the casing 120 as measured between inner casing walls 124 is 8.63 inches. The outer diameter of the casing 120 as measured between outer casing walls 122 is 9.63 inches. As shown, the calculated radial distance between the central axis 110 of mill 32 and the inner casing wall 124 is 2.57 inches. Therefore, in this example, the casing cutting section 130 of the mill 32 begins with those cutting elements that are positioned on the mill 32 greater than about 2.57 radial inches from the central axis 110 of the mill 32. The casing cutting section 130 of the mill 32 includes those cutting elements at a radial position greater than 2.57 inches but does not include those cutting elements at the gage radius, i.e., the gage cutting elements in section 118 (FIG. 7B) generally above point "B" (FIG. 8).

While FIG. 9 illustrates how the casing cutting section 130 of a 8.5 inch gage mill 32 in 9 ⅝ inch casing may be calculated, those skilled in the art will readily recognize that similar calculations may be done to define the casing cutting section 130 of various other size mills and casing. Those skilled in the art will also readily recognize that the offset of the mill diameter into the full gauge chord of the casing wall applies not only to the lead mill but also to the sizes, spacing and offsets of all subsequent mills in the cutting tool/assembly, such as a follow mill, a dress mill and any reaming mills. When combined with the bridging and cantilever geometries of multiple mills, those skilled in the art will further recognize how the effects of flats and shallow tapers on the whipstock ramps can be used to advantage to optimize the offsets of the mills across a range of casing sizes and thicknesses.

Returning to FIG. 2A, and as disclosed above, the whipstock ramp profile 38 may be selected or designed to provide the desired loading or a predetermined loading across a given mill 31, 32 and cutters 34 during milling of a casing window 28. Subsequently, and optionally, another mill design may be selected to use in combination with the previously designed or selected whipstock ramp profile 38 to further provide balanced loading across cutters 34 during the milling of a casing window 28.

Figure 10:
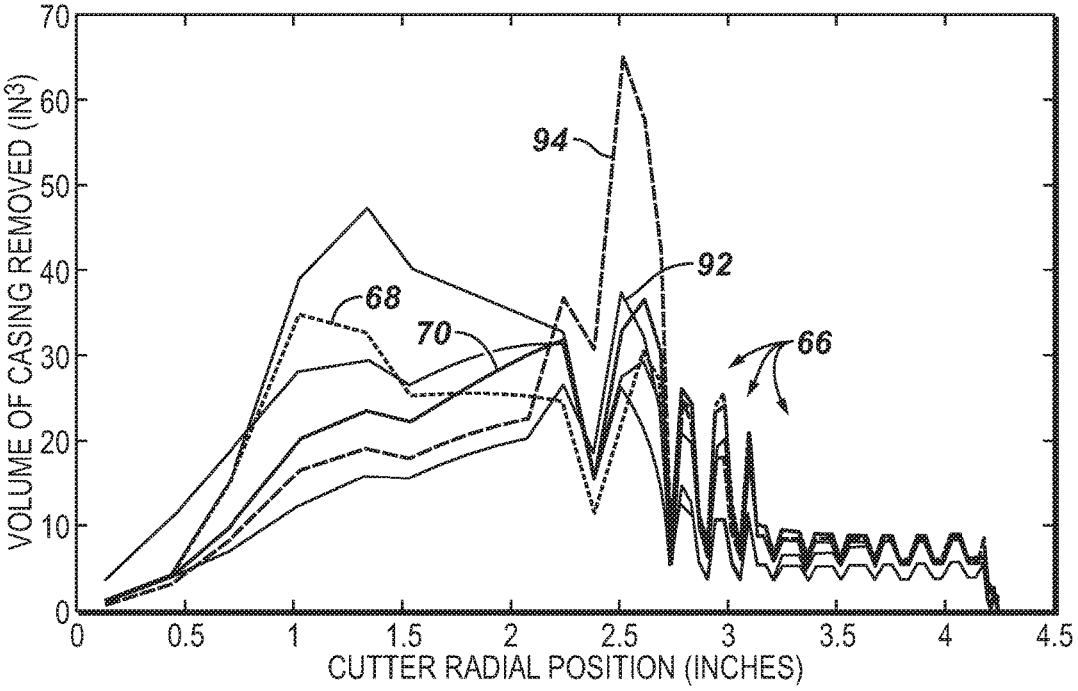
FIG. 10 is a graphical representation of the volume of casing removed by, and thus the loading incurred by, cutters along the radial position of a mill for a variety of whipstocks.

In FIG. 10, a graph is provided illustrating the volume of casing removed (and thus the loading) by cutter/cutting elements on the mill 31 versus cutter/cutting element radial position for a variety of whipstock ramp profiles 38 employed with mill 31. Several graph lines 66 illustrate the substantial differences in casing material removed and thus the differences in consequential cutter loading between several designs of whipstock 36 employed with the mill 31. By specifically designing whipstock 36 for the specific mill 31 and arrangement of cutters 34, the loading effects may be substantially altered across the mill 31 as desired. By way of example, graph lines 68 (representing the Whip "A" of FIGS. 5) and 70 (representing Whip "B" of FIG. 5) reflect a substantially balanced loading across the conventional mill 31 during cutting of casing window 28 in well casing 26. As such, graph line 68 indicates the volume of casing removed and the consequential loading incurred by using the whipstock ramp profile 30 having the ramp sections and angular orientations illustrated graphically in FIG. 4. Similarly, graph line 70 indicates the volume of casing removed and the consequential loading incurred by using the whipstock ramp profile 38 having the ramp sections and angular orientations illustrated graphically in FIG. 4. For comparison, graphical line 92 illustrates the volume of casing removed and the consequential loading incurred by the cutters using a conventional whipstock (see FIG. 3A) in conjunction with conventional mill 31. Graphical line 94 illustrates the volume of casing removed and the consequential loading incurred by the cutters using a conventional whipstock, which has been extended in length similarly that shown in FIG. 3B, in conjunction with conventional mill 31.

Figure 11:
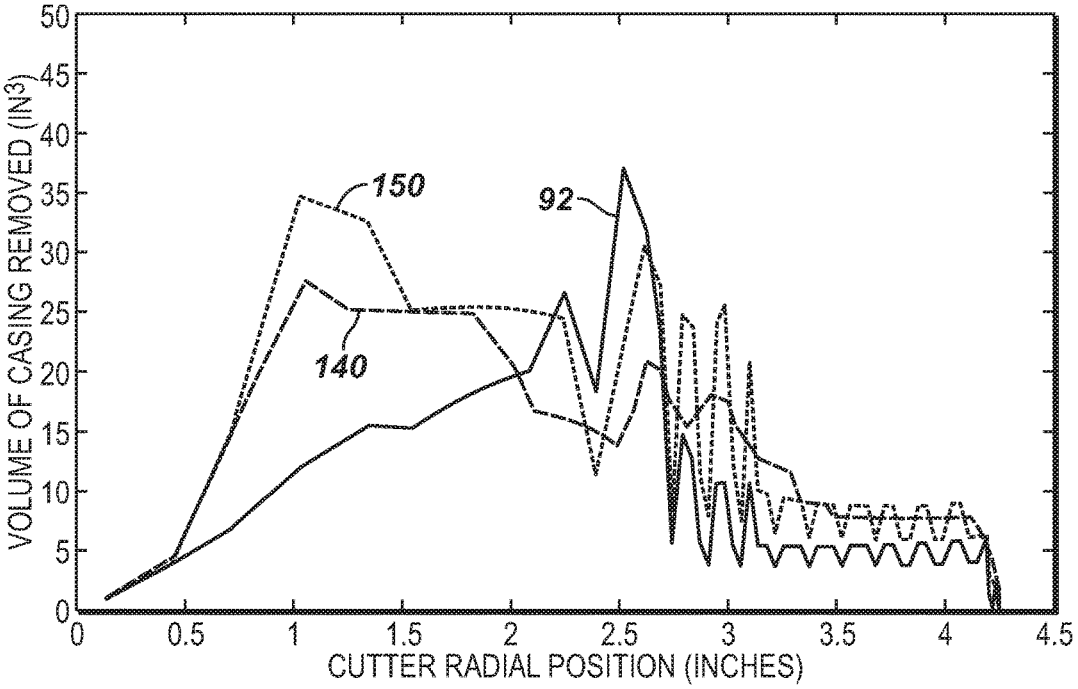
FIG. 11 is a graphical representation of the volume of casing removed by, and thus the loading incurred by, cutters along the radial position of a conventional and mill of the present disclosure using a whipstock of the present disclosure as compared to a conventional mill and whipstock.

FIG. 11 provides a graphical representation of the volume of casing removed by, and thus the loading incurred by, cutters along the radial position of a conventional and designed mill using a designed whipstock as compared to a conventional mill and conventional whipstock. Graphical line 150 represents the calculated volume of casing removed per cutter/cutting element for a conventional mill 31 using the whipstock design, Whip "A", of FIG. 5. Graphical line 140 represents the calculated volume of casing removed per cutter/cutting element for designed mill 32 of one embodiment of the present disclosure also using whipstock design, Whip "A", of FIG. 5. For comparison, graphical line 92 illustrates the volume of casing removed and the consequential loading incurred by the cutters using a conventional whipstock in conjunction with conventional mill 31.

Based on FIG. 11, those skilled in the art can readily identify that the mill 32, according to one or more embodiments of the present disclosure, provides a greater balancing of the calculated volumes of casing removed by the individual cutters/cutting elements across the casing cutting section 130 of the mill than solely using an improved whipstock ramp profile, Whip "A", as in this example. This confirms that the additional cutting elements added to the casing cutting section 130 of the mill 32 act to balance the calculated casing removal volume per cutter/cutting element. It has been determined that the cutting elements in the casing cutting section 130 of mill 32 are sufficient in number and/or are suitably disposed to limit the absolute difference in calculated casing volume removed by radially adjacent cutting elements in the casing cutting section 130 to less than at least about 35 percent. In yet other embodiments, the absolute difference in calculated casing volume removed by radially adjacent cutting elements in the casing cutting section 130 may range from less than about 25 percent to less than about 30 percent. In one or more additional embodiments, the absolute difference in calculated casing volume removed by radially adjacent cutting elements in the casing cutting section 130 may range from less than about 10 percent to less than about 20 percent. Furthermore, the absolute difference in calculated casing volume removed by radially adjacent cutting elements along the entire mill may range from less than about 25 percent to less than at least about 35 percent. Thus, the desired balancing or predetermined balancing of cutting load is produced when the difference between volumes of well casing cut by radially adjacent cutting elements of the plurality of cutting elements is driven towards zero. It has also been determined that, in one or more embodiments, there is no absolute difference greater than about 30 percent in the spacing between radially adjacent cutting elements in the casing cutting section 130. As defined herein, the term, radially adjacent cutting elements, means cutting elements that are adjacent to each other in radial distance from a central axis of the mill whether on the same blade or a different blade of the mill. The absolute difference in the calculated casing volume removed is the absolute value of the difference in calculated casing volumes removed between radially adjacent cutting elements.

Figure 12:
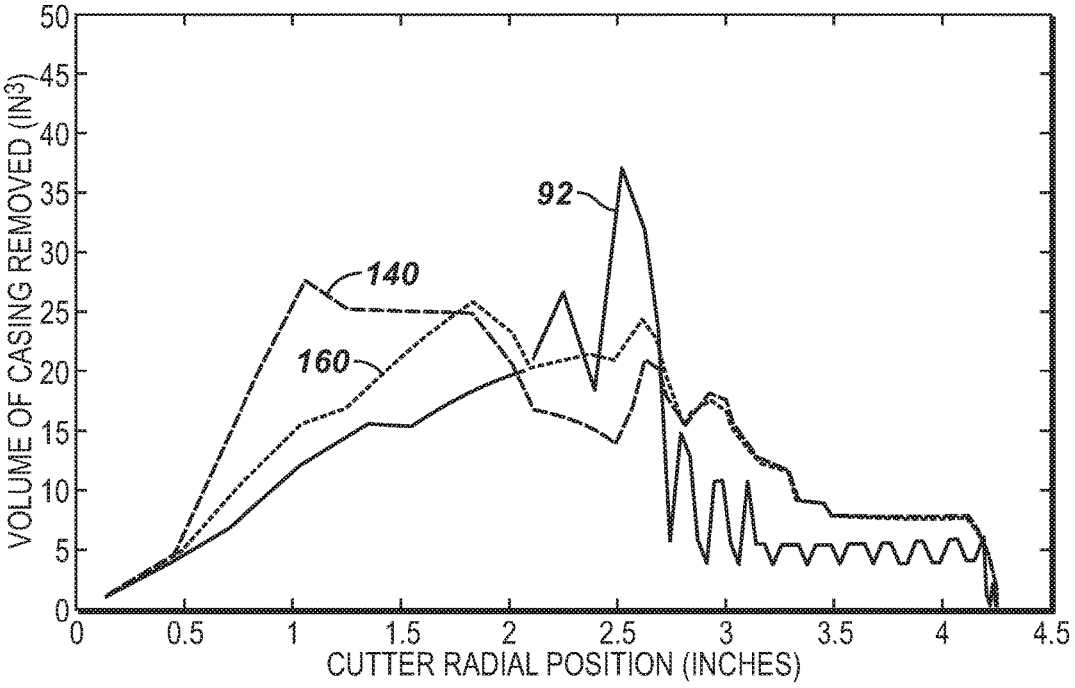
FIG. 12 is a graphical representation of the volume of casing removed by, and thus the loading incurred by, cutters along the radial position of a mill of the present disclosure using a plurality of whipstocks according to embodiments of the present disclosure as compared to a conventional mill and whipstock.

FIG. 12 provides a graphical representation of the volume of casing removed by, and thus the loading incurred by, cutters along the radial position of an improved mill 32 using a plurality of improved whipstocks as compared to a conventional mill and conventional whipstock. Graphical line 140 in FIG. 12 is the same as shown in FIG. 11. Graphical line 160 represents the calculated volume of casing removed per cutter/cutting element for mill 32 using a whipstock having ramp profile design, Whip "B", of FIG. 5. For comparison, graphical line 92 illustrates the volume of casing removed and the consequential loading incurred by the cutters using a conventional whipstock in conjunction with conventional mill 31. As illustrated in FIG. 12, graphical lines 140 and 160 indicate that for mill 32 each of the plurality of cutting elements on Whip "A" or Whip "B", respectively, has a cutting loading no greater than about 30 cubic inches of well casing cut/removed.

Regardless of whether the whipstock 36 is to be designed to facilitate use of a given mill/cutter configuration or to best accommodate a specified DLS for one or more drilling tools, the selection of the whipstock ramp profile 38 can benefit from an iterative design process. Initially, application parameters are gathered and analyzed. Operational results are calculated, and the parameters, e.g., whipstock ramp section lengths and angles, are continuously adjusted in an iterative process until an optimum system solution is achieved. This optimization ensures that the mill and/or other related equipment does not fail prematurely. With respect to DLS, and as illustrated in FIG. 1, the use of either of whipstock designs "A" and "B" (unlike conventional whipstock designs) yield calculated dogleg severities for all listed components below 8 degrees per 100 feet—the maximum dogleg severity that should be experienced by various bottomhole assembly components while rotating through milled casing windows. FIG. 1 further shows that all components listed would experience a calculated dogleg severity at or below about 7 degrees per 100 feet using either whipstock design "A" or "B." Furthermore, as shown by FIG. 1, a majority of the bottomhole assembly components, including the MWD, the heavy weight drill pipe, and the float/filter subs, would experience a calculated dogleg severity of at or below about 4 degrees per 100 feet using either of the whipstock designs "A" and "B".

Figure 13:
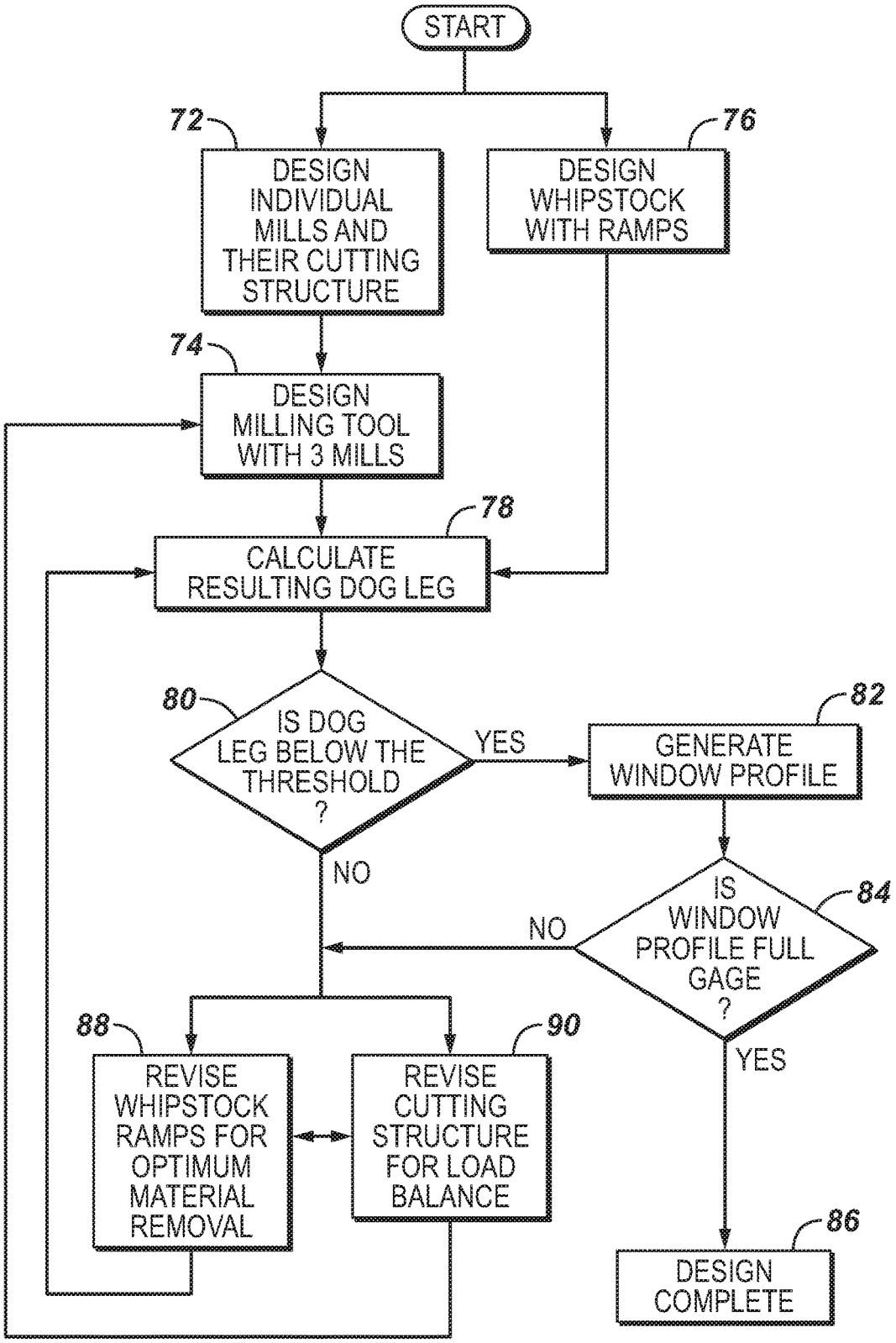
FIG. 13 is a flowchart illustrating an iterative process used to facilitate the design of a desired whipstock and mill, according to one or more embodiments of the present disclosure.

Referring generally to FIG. 13, an example of an iterative process is provided to facilitate the design of mills and whipstocks while also accommodating the specified DLS of the milling/drilling equipment. In this example, mill 31, 32 and its cutting structure, e.g., arrangement of cutters 34, are initially selected or designed, as represented by block 72. For example, a mill 31, 32 having three mills (blades) and a specific arrangement of cutters 34 may initially be selected, as represented by block 74. Additionally, a whipstock 36 is initially designed or selected with a given ramp profile 38 having a plurality of ramp sections oriented at specific angles with respect to the longitudinal axis 54, as represented by block 76.

Based on the initial parameters of the mill 31, 32 and whipstock 36, a resulting DLS can be calculated by methods well known to those skilled in art, as represented by block 78. The calculated dogleg is then evaluated to determine whether it is below a given threshold, as represented by decision block 80. If it is below the threshold, a casing window profile may be generated, as represented by block 82. Once the window profile is generated, a determination is made as to whether the window profile is full gauge, as represented by decision block 84. If the window profile is full gauge, the design is complete, as indicated by block 86.

If, however, the dogleg is not below the threshold (see decision block 80) or the window profile is not full gauge (see decision block 84), further revision is required. For example, the whipstock ramps may be optimized (e.g., by angle and length) for improved material removal, as represented by block 88. Additionally or alternatively, the cutting structure of mill 31, 32 may be revised to alter the load balance acting on the mill 31, 32, as represented by block 90. Once revisions are made to either the whipstock ramps or the mill cutting structure, the resulting DLS is again calculated and the process is repeated. The iterative process enables optimization of one or both of the whipstock 36 and the mill 31, 32 to achieve a desired loading, material removal, cutting speed, and/or other specific results for a given application.

It should be noted that the iterative process may be adjusted to optimize a variety of characteristics. For example, the iterative process may be used to optimize whipstock design for achieving a balanced load distribution for a conventional mill 31 or specifically designed mill 32 (e.g., specifically designed to better balance the load distribution among the cutters). In other applications, the iterative process may be used to optimize mill design for a specific whipstock. Similarly, the process may be used to optimize other characteristics, e.g., cutting speed, depending on the needs of a specific milling and/or drilling operation in a specific environment.

Although only a few embodiments of the present disclosure have been described in detail above, those skilled in the art will readily appreciate that many variations and/or modifications are possible without materially departing from the teachings of this disclosure. Accordingly, such variations and/or modifications are intended to be included within the scope of this disclosure.

As used herein, "about" and "approximately" will be understood by person of ordinary skill in the art and will vary to some extent on the context in which they are used. If there are uses of the term which are not clear to persons of ordinary skill in the art given the context in which it is used, "approximatelt" may mean plus or minus 10% of a particular amount or number. For example, approximately 10% may refer to a percentage between 9% and 11%.

What is claimed is:

1. A method for manufacturing a mill structure for milling a window in a cased wellbore, comprising:

determining a configuration of a cutting structure of a mill to cut a window in a well casing, the cutting structure of the mill having sets of radially adjacent cutting elements on a plurality of blades of the mill;

determining a configuration of a whipstock having a plurality of ramp sections;

calculating a volume of casing removed in cutting the window per set of cutting radially adjacent cutting elements based on a predicted movement of the mill along the plurality of ramp sections of the whipstock;

based on the calculated volume of the casing removed, balancing a volume of casing removed between each set of radially adjacent cutting elements by adjusting one or more of the configuration of the cutting structure of the mill and the configuration of the whipstock subject to a constraint that a difference in volume of casing removed in cutting the window between each set of radially adjacent cutting elements does not exceed about 30%; and manufacturing the mill structure having a configuration of a cutting structure based on the adjusted configuration of the cutting structure and in accordance with the adjusted configuration of the whipstock.

2. The method of claim 1, wherein balancing the volume of casing removed between each set of radially adjacent cutting elements comprises iteratively modifying the configuration of the cutting structure of the mill or the configuration of the whipstock until satisfying the constraint that the difference in volume of casing removed between each set of radially adjacent cutting elements does not exceed about 30%.

3. The method of claim 1, wherein balancing the volume of casing removed between each set of radially adjacent cutting elements comprises iteratively modifying the configuration of the cutting structure of the mill or the configuration of the whipstock to minimize the volume of casing removed between each set of radially adjacent cutting elements.

4. The method of claim 1, wherein determining the configuration of the whipstock includes determining an angular orientation and a length of each ramp section of the plurality of ramp sections.

5. The method of claim 1, wherein determining the configuration of the whipstock includes determining a unique angular orientation and a unique length for each ramp section of the plurality of ramp sections.

6. The method of claim 1, wherein determining the configuration of the whipstock includes determining a number of ramp sections.

7. The method of claim 1, wherein balancing the volume of casing removed between each set of radially adjacent cutting elements comprises iteratively modifying both the configuration of the cutting structure of the mill and the configuration of the whipstock until satisfying the constraint that the difference in volume of casing removed between each set of radially adjacent cutting elements does not exceed about 30%.

8. The method of claim 1, wherein balancing the volume of casing removed between each set of radially adjacent cutting elements comprises iteratively modifying both the configuration of the cutting structure of the mill and the configuration of the whipstock to minimize the volume of casing removed between each set of radially adjacent cutting elements.

9. The method of claim 1, further comprising: calculating a cutting load per cutting element for each cutting element based on the predicted movement of the mill along the plurality of ramp sections of the whipstock.

10. The method of claim 9, further comprising: balancing the cutting load between each set of radially adjacent cutting elements by adjusting one or more of the configuration of the cutting structure of the mill and the configuration of the whipstock.

11. The method of claim 10, wherein balancing the cutting load includes modifying at least one of the configuration of the cutting structure and the whipstock-and re-calculating the cutting load on a per cutting element basis until each of the plurality of cutting elements has a cutting load no greater than about 30 cubic inches of well casing cut.

12. A method for milling a window in a cased wellbore, comprising:

tripping a mill into a wellbore, the mill being arranged and designed to mill a window in a well casing using a plurality of cutters coupled to circumferentially offset blades of the mill, the plurality of cutters comprising sets of radially adjacent cutters corresponding to respective portions of the circumferentially offset blades of a cutting structure of the mill;

tripping a whipstock into the wellbore, the whipstock having at least one ramp section configured to move the mill in a lateral direction during milling of the window; and milling a window in the well casing by moving the mill along the at least one ramp section of the whipstock, wherein milling the window includes loading the plurality of cutters such that an absolute difference in casing volume removed in cutting the window in the well casing by each set of radially adjacent cutters while moving along the least one ramp section of the whipstock is less than about 35%.

13. The method of claim 12, wherein milling the window includes loading the cutters such that each cutter of the plurality of cutters on the mill removes no more than about 30 cubic inches of well casing.

14. The method of claim 12, wherein milling a window in the well casing by moving the mill along the at least one ramp section of the whipstock includes milling with a dogleg severity of less than 4 degrees per 100 feet.

15. The method of claim 12, wherein the respective portions of the circumferentially offset blades of the cutting structure of the mill comprise two or more of:

a cone section;

a nose section;

a taper section; and a gage section.

16. The method of claim 12, wherein each set of radially adjacent cutters corresponding to the respective portions of the circumferentially offset blades includes a different number of cutters.

17. A mill for cutting a window through casing in a borehole, comprising:

a lead mill body having a plurality of circumferentially offset blades; and a plurality of cutting elements coupled to the plurality of offset blades, the plurality of cutting elements comprising sets of radially adjacent cutting elements corresponding to radially offset portions of the lead mill body coupled to respective blades of the plurality of offset blades and being arranged and designed to limit an absolute difference in calculated casing volume removed in cutting a window in a well casing while moving in a direction defined by one or more ramp sections of a whipstock by each set of radially adjacent cutting elements to less than about 35 percent.

18. The mill of claim 17, the plurality of cutting elements being arranged and designed to limit the absolute difference in calculated casing volume removed by each set of radially adjacent cutting elements to less than about 30 percent.

19. The mill of claim 17, the plurality of cutting elements being arranged and designed to limit the absolute difference in calculated casing volume removed by each set of radially adjacent cutting elements to less than about 25 percent.

20. The method of claim 17, wherein the well casing comprises an outer casing of a cylindrical borehole, and wherein the direction defined by the one or more ramp sections of the whipstock is a lateral direction relative to a vertical orientation of the cylindrical borehole.

* * * * *